US005650022A

United States Patent [19]

Kitano et al.

[11] Patent Number: 5,650,022

[45] Date of Patent: Jul. 22, 1997

[54] METHOD OF NITRIDING STEEL

[75] Inventors: Kenzo Kitano, Kawachinagano; Akio Hashigami, Sanda; Takashi Muraoka, Mino, all of Japan

[73] Assignee: Daido Hoxan Inc., Sapporo, Japan

[21] Appl. No.: 648,852

[22] Filed: May 16, 1996

[30] Foreign Application Priority Data

May 25, 1995 [JP] Japan ..... 7-126783

[51] Int. Cl.[6] ..... C23C 8/26

[52] U.S. Cl. ..... 148/228; 148/231; 148/232

[58] Field of Search ..... 148/228, 231, 148/232

[56] References Cited

U.S. PATENT DOCUMENTS 5,013,371 5/1991 Tahara et al. ..... 148/231

5,254,181 10/1993 Yoshio et al. ..... 148/231

5,340,412 8/1994 Yoshino et al. ..... 148/231

*Primary Examiner*—Deborah Yee

*Attorney, Agent, or Firm*—Armstrong, Westerman, Hattori, McLeland & Naughton

[57] ABSTRACT

A method of nitriding steel which comprises reacting the steel surface with nitrogen so as to form a hard nitrided layer, and, prior to nitriding, holding steel under a gas atmosphere containing fluorine compound gas or fluorine gas and also containing air of 0.5 to 20 volume % of the total or oxygen gas of 0.1 to 4 volume % of the total with heating, whereby occurrence of uneven nitriding is prevented and at the same time savings in consumption of expensive fluorine- or fluoride-containing gas can be realized.

4 Claims, 1 Drawing Sheet

METHOD OF NITRIDING STEEL

FIELD OF THE INVENTION

This invention relates to a method of nitriding steel by forming a nitrided layer on the steel surface so as to improve wear resistance and other properties.

BACKGROUND OF THE INVENTION

Methods of nitriding or carbonitriding steel for the formation of a nitrided layer on their surface which have been so far employed for the purpose of improving their mechanical properties, such as wear resistance, corrosion resistance and fatigue strength, include the following, among others:

(a) The method using a molten cyanate or cyanide salt, such as NaCNO or KCN (Tufftride method);

(b) The glow discharge nitriding method (plasma nitriding method ); and (c) The method using ammonia or a mixed gas containing ammonia and a carbon source, for example RX gas (gas nitriding or gas soft nitriding method).

Among these method, (a), which uses hazardous molten salts, has a dark future when evaluated from work environment, waste treatment and other viewpoints. Method (b), which achieves nitriding by means of a glow discharge in an $N_2$+$H_2$ atmosphere under a low degree of vacuum, causes less influences of oxide films owing to some cleaning effect of sputtering but tends to allow occurrence of uneven nitriding due to local temperature differences. In addition, this method is disadvantageous in that articles which can be nitrided are much limited in shape and size and that increases in cost result. Method (c) also has problems, for instance, the treatment process is not very stable but tends to lead to uneven nitriding. Another problem lies in that obtaining a deep nitrided layer requires a fairly long time.

Generally, steel is nitrided at temperatures not lower than 500°C. For the adsorption and diffusion of nitrogen on the steel surface layer, it is desired that the metallic surface should be highly active and free not only of organic and inorganic contaminants but also of any oxide film or adsorption film for $O_2$. The above-mentioned oxide film, if present, would unfavorably promote dissociation of the nitriding gas ammonia. In practice, however, it is impossible to prevent oxide film formation in gas nitriding. For instance, even in the case of case hardened steel or structural steel whose chromium content is not high, thin oxide films are formed even in an $NH_3$ or $NH_3$+RX atmosphere at temperatures between 400° to 500° C . This tendency becomes more pronounced with steel species containing an element or elements which have high affinity for oxygen, for example chromium, in large amounts.

The oxide formation, such as mentioned above, varies in extent depending on the surface state, processing conditions and other factors even in one and the same work, resulting in unevenly nitrided layer formation. For example, in the typical case of cold worked austenite stainless steel works, satisfactory nitrided layer formation is almost impossible even if passive surface coat layers are completely removed prior to charging into a treatment furnace by cleaning with a hydrofluoric acid-nitric acid mixture. Uneven nitriding occurs not only in gas soft nitriding but also in nitriding of nitriding steel or stainless steel with ammonia alone (gas nitriding). Furthermore, in the case of works complicated in geometry, for example gears, even when they are made of ordinary structural steel, it is a fundamental problem that there is a general tendency to uneven nitriding.

The means or methods so far proposed for solving the above-mentioned essential problems encountered in gas nitriding ad gas soft nitriding include, among others, the one comprising charging vinyl chloride resin into a furnace together with works, the one comprising sprinkling works with $CH_3Cl$ or the like and heating at 200°–300° C. to thereby cause evolution of HCl and prevent oxide formation and remove oxides therewith, and the one comprising plating works in advance to thereby prevent oxide formation. None of them have been put into practical use, however. Chlorides such as $FeCl_2$ and $FeCl_3$ are deposited on the steel surface by HCl, however, these chlorides are very fragile at temperatures below the nitriding temperature and can readily sublime or vaporize, whereby no chloride layer is formed. Furthermore, the handling of the above-mentioned chlorides and the like is troublesome and furnace material is extremely damaged, although they are effective to some extent in preventing oxide film formation. Thus, none of the methods mentioned above can be said to be practicable.

OBJECTS OF THE INVENTION

As mentioned heretofore, the conventional methods have problems such as inorganic contaminants remained after cleaning prior to nitriding, and occurrence of uneven nitriding and the like caused by oxide films of treated articles. In order to solve the above problems effectively, the inventors of the present invention have found out that it is effective to hold steel in an atmosphere composed of a fluoride compound or fluorine (hereinafter abbreviated to fluorine- or fluoride-containing gas) with heating prior to nitriding so as to form a fluoride layer on the steel surface. Such an invention has already been filed to the Japanese Patent Office (the application number is 1-177660). In this way, by treating with the fluorine- or fluoride-containing gas, inorganic and organic contaminants attached to the steel surface by activated fluorine atoms are destroyed and eliminated so that the steel surface is cleaned. Further, these fluorine atoms undergo reaction with the oxide film so as to turn into a fluoride film, resulting in a state that the steel surface is covered and protected by the fluoride film. This fluoride layer is eliminated by decomposition in the next nitriding step. At the same time, the steel surface becomes an activated state. Nitrogen atoms then penetrate and diffuse into this activated steel surface, allowing to form a nitrided layer quickly and uniformly. In the actual operation procedure, however, the above fluorine- or fluoride-containing gas is expensive and its consumption is considerably high, therefore, the cost of nitriding itself becomes high, causing a strong demand for the improvement.

DISCLOSURE OF THE INVENTION

To accomplish the above problems, this invention provides a method of nitriding steel which comprises reacting the steel surface with nitrogen so as to form a hard nitrided layer, and conducting the following fluorination (A), (B) or (C) prior to nitriding:

(A) holding steel in a gas atmosphere containing fluorine compound gas or fluorine gas and also containing air equivalent to 0.5 to 20 volume % of the total or oxygen gas equivalent to 0.1 to 4 volume % of the total with heating;

(B) after holding steel in a gas atmosphere containing fluorine compound gas or fluorine gas with heating, holding steel in a gas atmosphere containing air equivalent of 0.5 to 20 volume % of the total or oxygen gas equivalent to 0.1 to 4 volume % of the total with heating; or (C) after holding steel in a gas atmosphere containing air equivalent to 0.5 to 100 volume % of the total or oxygen gas equivalent to 0.1 to 20 volume % of the total with heating, holding steel in a gas atmosphere containing fluorine compound gas or fluorine gas with heating.

Namely, the inventors of the present invention have been piling up a series of researches with aiming to improve the prior proposals. As a result, we found out that, prior to nitriding steel, when fluorination is conducted by introducing fluorine- or fluoride-containing gas into a furnace while steel is held therein with heating, if the fluorination takes place in a gas atmosphere containing not only the above fluorine- or fluoride-containing gas but also air equivalent to 0.5 to 20 volume % of the fluorine- or fluoride-containing gas or oxygen gas equivalent to 0.1 to 4 volume % (hereinafter abbreviated to %) thereof, the consumption of the fluorine- or fluoride-containing gas is less than that of the prior proposals. It was also found out that the above method can provide similar or better effects (where inorganic and organic contaminants attached to the steel surface are destroyed and eliminated by fluorine atoms, the oxide film on the steel surface turns to a fluoride film by reacting with the fluorine atoms so that the steel surface may be covered and protected by the fluoride film, and the fluoride film is eliminated by decomposition in the next step of nitriding so that the steel surface is activated and that nitrogen atoms can penetrate and diffuse thereinto quickly and uniformly) than those of the prior proposals. In addition it is not necessarily required to conduct fluorination in the state of co-existence of fluorine- or fluoride-containing gas with air and the like. That is, after or at the same time steel is held in a fluorine- or fluoride-containing gas atmosphere with heating so as to form a fluoride film on the steel surface, steel may undergo heat treatment in a gas atmosphere where the above air or oxygen is mixed with nitrogen or ammonia and introduced into the furnace as a mixed gas. Moreover, it may be possible that the above air or oxygen is mixed with nitrogen as or the like and introduced into the furnace as a mixed gas, where steel is held with heating and thereafter the above fluorine- or fluoride-containing gas is introduced thereinto in which steel is held with heating. We found out that such methods can provide the same effects as those when the fluorine- or fluoride-containing gas is simultaneously used with air or oxygen.

The present invention will then be described in detail.

As the fluorine- or fluoride-containing gas (a gas containing fluorine compound gas or fluorine gas) used in this invention, there are fluorine compound gases containing fluorine compounds such as $NF_3$, $BF_3$, $CF_4$ and $SF_6$, and gases containing $F_2$ gas. The fluorine- or fluoride-containing gas is normally composed of this fluorine compound gases or $F_2$ gas, and its dilute gas ($N_2$ gas or the like). Among the fluorine compound gases and the $F_2$ gas which are used for the fluorine- or fluoride-containing gas, $NF_3$ is most suitable for practical use since it is superior in reactivity, ease of handling and the like. A steel article to be treated is held with heating under the above fluorine- or fluoride-containing gas atmosphere, in the case, for example, of $NF_2$, at a temperature of 250° to 600° C. so that the surface is treated therewith, and thereafter nitrided (or carbonitrided) by using such a known nitriding gas as ammonia. As mentioned foregoing, the above $NF_3$ gas and the like are usually used after being diluted with nitrogen gas. In this fluorinating process, the concentration of fluorine compounds or fluorine in a fluorine- or fluoride-containing gas atmosphere is 1000 to 100000 ppm in accordance with a volume standard (the same applies hereinafter).

This invention combines the effect of the above fluorine-fluoride-containing gas with the effect of air or oxygen gas, which results in the most significant feature. There are following three embodiments in the present invention as to the combination of the above air or oxygen gas and the fluorine- or fluoride-containing gas. The first embodiment of the combination is to introduce air or oxygen into the fluorine- or fluoride-containing gas and mix them. In this way, when mixing the fluorine- or fluoride-containing gas with air or oxygen, air is determined to be at 0.5 to 20% of the total of the fluorine- or fluoride-containing gas and air and the like to be mixed with. As for oxygen, it is determined to be 0.1 to 4% of the above total. The second embodiment is to hold steel under a fluorine- or fluoride-containing gas atmosphere with heating so as to form a fluoride film on the steel surface, and simultaneously or thereafter, to introduce air or oxygen as a mixed gas with nitrogen gas or $NH_3$ gas wherein air accounts for 0.5 to 20% or oxygen 0.1 to 4% of the total (of the atmosphere). Further, the third embodiment is to introduce air or oxygen as a mixed gas with an inert gas such as nitrogen gas into a furnace prior to introducing the above fluorine- or fluoride-containing gas, to hold steel therein with heating, and thereafter to introduce the above fluorine- fluoride-containing gas thereinto in order to form a fluoride film on the steel surface. In this case, before the introduction of the fluorine- or fluoride-containing gas, air or oxygen to be introduced into a furnace shall be set at 0.5 to 100% or 0.1 to 20%, of the total of the above atmosphere, respectively.

In the above first and second embodiments, good results cannot be obtained even if either air or oxygen falls without the above ranges. In this case, air to be used is generally cleaned with reduced contents of impurities such as hydro carbons, moisture and carbon dioxide. As oxygen gas, pure oxygen gas can be used as it is, or, alternatively, pure oxygen gas which is diluted by other dilute gases such as $N_2$ gas can be used. In this case, pure oxygen is also set at 0.1 to 4% of the total.

The holding time of steel under the above atmosphere may be selected appropriately depending on types of steel, shapes and dimensions of works, heating temperatures and the like. It is usually from ten and odd minutes to dozens of minutes.

The method in accordance with the instant invention will specifically be described. A steel work is, for example, cleaned by degreasing, and charged into a heat treatment furnace 1 shown in FIG. 1. This furnace 1 is a pit furnace where a stainless inner vessel 4 is provided inside a heater 3 equipped in an outer shell 2, and a gas inlet pipe 5 and an exhaust pipe 6 are inserted thereinto. Gases are supplied from cylinders into the gas inlet pipe 5 through a flow meter 17, a valve 18 and the like. The inside atmosphere is stirred by a fan 8 rotated by a motor 7. A work 10 placed in a wire net container 11 is charged into the furnace 1. In the figure, the reference numeral 13 is a vacuum pump and 14 an eliminator. Fluorine- or fluorine-containing gas such as a mixed gas of $NF_3$ and $N_2$ from the cylinder is introduced into the furnace, simultaneously, air from the cylinder being introduced thereinto, whereby the furnace is heated to a determined reaction temperature. $NF_3$ generates active radicals of F at a temperature of 250° to 600° C., which eliminate organic and inorganic contaminants remaining on the surface, and at the same time react quickly with Fe and Cr bases on the steel surface or oxides such as FeO, $Fe_3O_4$, and $Cr_2O_3$. As a result, a very thin fluoride film containing such compounds as $FeF_2$, $FeF_3$, $CrF_2$, and $CrF_4$ forms on the steel surface, for example as follows:

$$FeO+2F \rightarrow FeF_2+\tfrac{1}{2}O_2; \text{ and}$$

$$Cr_2O_3+4F \rightarrow 2CrF_2+\tfrac{3}{2}O_2.$$

These fluorinating reactions convert the oxide film on the work surface to a fluoride film, resulting in the formation of the fluoride film on the work surface. In this case, not only fluorine compound gas or $F_2$ gas, but also air is included in the above atmosphere. It is understood that the $O_2$ film is formed on the surface of the fluoride film generated due to $O_2$ in the air, which reinforces the fluoride film. Since such an $O_2$ film reinforces the fluoride film, occurrence of nitriding unevenness in the next step is prevented and, simultaneously the consumption of expensive fluorine compound and $F_2$ gas are reduced so that reductions in the nitriding cost can eventually be realized.

In addition, the above fluorinating reactions may occur other than by mixing the fluorine- or fluoride-containing gas with air or oxygen simultaneously, for example as follows. After steel is held under the fluorine- or fluoride-containing gas atmosphere with heating in the furnace, air or oxygen gas is introduced thereinto, forming a gas atmosphere containing air of 0.5 to 20% or oxygen gas of 0.1 to 4% of the total atmosphere, under which steel is held with heating. Consequently, the same effects can be obtained as those in simultaneous mixing. The above-mentioned fluorinating reaction can further be realized by, prior to the introduction of fluorine- or fluoride-containing gas, introducing air or oxygen with an inert gas and the like into the furnace, generating a gas atmosphere with air of 0.5 to 100% or oxygen gas of 0.1 to 20% of the total atmosphere, and holding steel therein with heating.

The work thus treated is subsequently heated, for instance, under a non-oxidation atmosphere such as $N_2$ atmosphere at a nitriding temperature of 480° to 700° C. It is assumed that if a gas containing $NH_3$ or $NH_3$ and a carbon source (for example, RX gas) is added thereto, the fluoride film is reduced or destroyed by $H_2$ or trace moisture, for example as shown in the following formulae so that an active metallic base is formed:

$$CrF_4+2H_2 \rightarrow Cr+4HF; \text{ and}$$

$$2FeF_3+3H_2 \rightarrow 2Fe+6HF.$$

As mentioned heretofore, as soon as the active metallic base is formed, active radicals of N are absorbed thereby so as to penetrate and diffuse thereinto, resulting in the formation of a compound layer containing such nitride as CrN, $Fe_2N$, $Fe_3N$ and $Fe_4N$ on the work surface.

This formation of the compound layer can also be seen in the conventional nitriding methods. However, the surface activity becomes low in the conventional methods because of an oxide film formed in the process where normal temperature rises to a nitriding temperature, and $O_2$ which is adsorbed during said process, whereby surface adsorption of N is low and uneven. Moreover, this unevenness is promoted by the fact that maintaining the degree of $NH_3$ decomposition uniformly in the furnace is difficult in practice. Therefore, the present invention can prevent occurrence of nitriding unevenness and save the consumption of expensive gases of main components, as the fluoride film formed on the steel surface is reinforced by the $O_2$ film. Thus, as a result of such fluorination, the present invention allows uniform and quick N adsorption on the work surface.

From the operational process viewpoint, it is an outstanding feature of the instant invention that it uses, as a reaction gas to form a fluoride film, a gaseous material like $NF_3$ which shows no reactivity at normal temperature and can be handled with ease, whereby the process is simplified, for example a continuous treatment becomes possible compared with the methods which involve plating treatment or use solid PVC or a liquid chlorine source. Tufftride method can hardly be said to have a bright future since a great expenditure is required, for instance, for work environment improvement and equipment for pollution, although it is excellent in promoting nitrided layer formation and increasing fatigue strength, among others. On the contrary, the above-mentioned process according to the invention requires only a simple device for eliminating hazardous substances from treated waste gas and allows, at least the same extent of nitrided layer formation as in Tufftride method and thereby makes it possible to avoid uneven nitriding. While nitriding is accompanied by carburizing in Tufftride method, it is possible to perform nitriding alone in the process according to the invention.

EFFECT OF THE INVENTION

As mentioned heretofore, the method of nitriding steel in accordance with the present invention comprises, prior to nitriding, conducting the following fluorinating method of ①, ② or ③:

① heating steel in a mixed gas containing fluorine- or fluoride-containing gas and air or oxygen;

② after heating steel under a fluorine- or fluoride-containing gas atmosphere, introducing air or oxygen with such an inert gas as $N_2$ into a furnace to hold steel with heating; or ③ prior to the introduction of fluorine- or fluoride-containing gas, introducing air or oxygen with such an inert gas as $N_2$ into a furnace so as to hold steel with heating, and introducing fluorine- or fluoride-containing gas thereinto where steel is held with heating. As a result, ① activated fluorine atoms act on the steel surface so as to remove inorganic and organic contaminants therefrom, ② at the same time, an oxide film on the surface is converted to a fluoride film, which is formed on the steel surface layer of steel to protect thereof, and ③ then, because the fluoride film is removed when nitriding and activated steel base is formed, the effects of fluorine compound gas and the like that quick and uniform penetration and diffusion of nitrogen on the activated surface of the steel base allow to form a good nitrided layer thereon in nitriding, are encouraged by the air or oxygen. Namely, fluorine- or fluoride-containing gas and air or oxygen are used in combination for fluorinating in the present invention. For this reason, the generated fluoride film is reinforced by the $O_2$ film, which prevents occurrence of uneven nitriding, at the same time, saves consumption of expensive fluorine- or fluoride-containing gas which relates to prevention of uneven nitriding, and in the end, realizes a great deal of cost reduction in nitriding. Therefore, the formation of a low-priced nitride layer can be realized on a broader range of steel types. In addition, the present invention provides a good nitrided layer regardless of types of steel, processing steps, conditions in pre-treatment or the like, and can conduct nitriding even on parts having holes or slits. Furthermore, there are advantages in the invention, for example, nitriding can be carried out on steel types which are difficult to be nitrided such as austenitic stainless steel and all types of heat-resistant steel.

Figure 1:
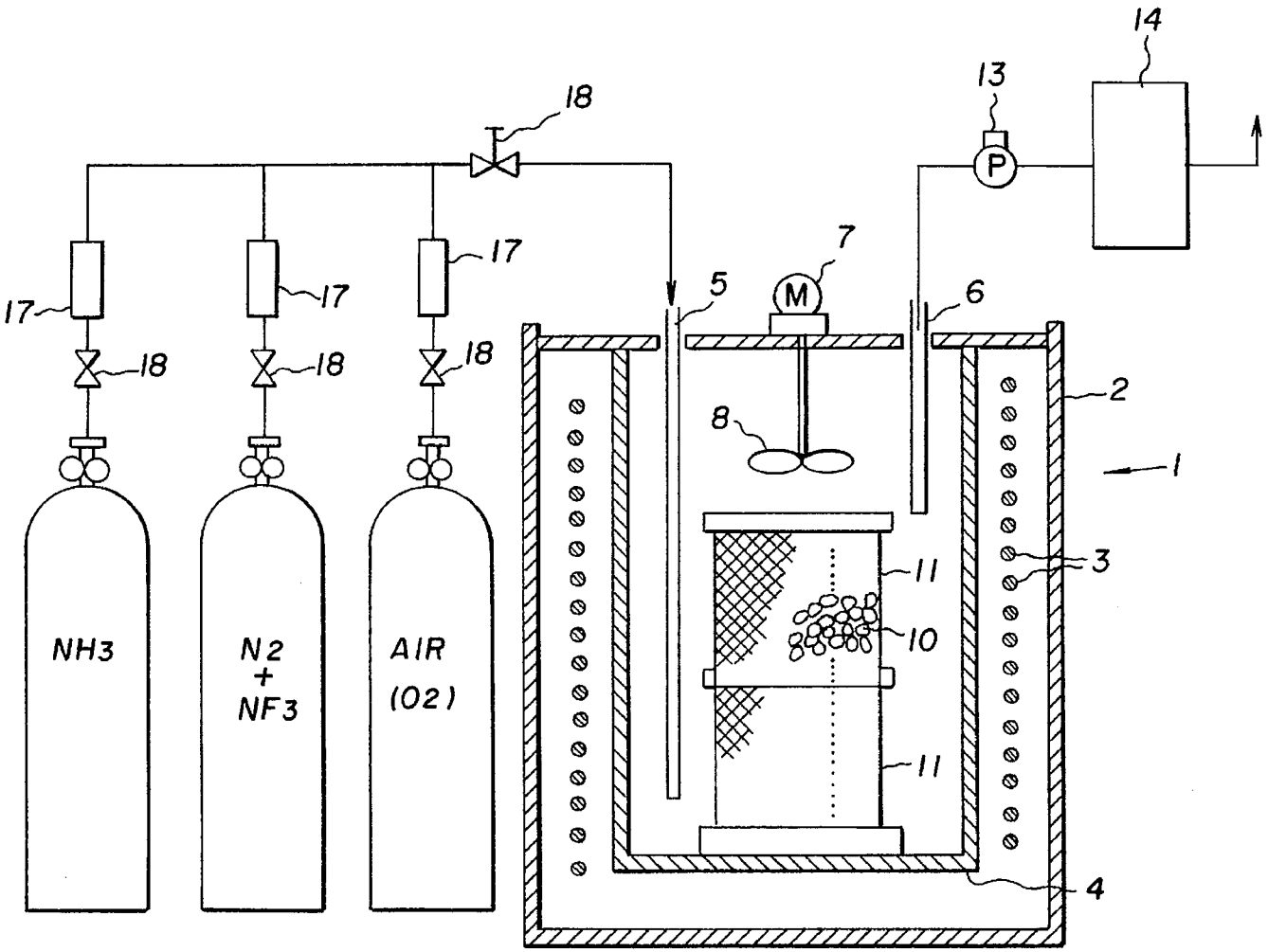
FIG. 1 shows a cross-sectional view of one embodiment of a treatment furnace used in the present invention.

The invention will further be described with reference to Examples compared with Comparative Examples.

EXAMPLE 1 AND COMPARATIVE EXAMPLES 1 TO 3

SUS 305 wire "screws" made by pressure molding were subjected to fluorocarbon then charged into such a furnace 1 as shown in FIG. 1, and held under an $N_2$ gas atmosphere comprising 40000 ppm of $NF_3$ and 50000 ppm of air (5 volume %) at 320° C. for 15 minutes. Thereafter, the screws were heated to 580° C. and nitrided for 3 hours in the furnace where a mixed gas containing 50% of $NH_3$ and 50% of $N_2$ was introduced. After a certain period of time, the screws were air cooled and taken out from the furnace.

The thicknesses of nitrided layers of the works obtained were uniform. The cross sectional hardnesses of screw threads ranged from Hv=350 to 360, whereas the whole surface hardnesses ranged from Hv=1200 to 1250.

On the contrary, as Comparative Example 1, the same works as in Example 1 were subjected to fluorocarbon then charged into the above furnace, and heated under an atmosphere comprising 75% of $NH_3$ at 570° C. for 3 hours. Nitride layers were hardly formed on the works.

Further, as Comparative Example 2, the same treatment as that of Example 1 was carried out except that the air content was changed to 0.4%, which falls out of the air range of 0.5 to 20% in this invention. Nitrided layers of thus obtained works were uneven and the surface hardnesses were between Hv=480 and 1250, which varied widely. It is understood that the performance thereof is much lower than that in Example 1.

Still further, as Comparative Example 3, the same treatment as that of Example 1 was carried out except that air content was set at 21%, which is an upper limit for air content in the present invention. Nitrided layers of thus obtained works were also uneven, and the whole surface hardnesses also varied widely. It is understood that the performance thereof is much lower than that in Example 1.

EXAMPLE 2 AND COMPARATIVE EXAMPLES 4 AND 5

SUS 505 tapping screws were cleaned by acetone, then charged into a furnace as shown in FIG. 1, and held under an $N_2$ atmosphere containing 35000 ppm of $NF_3$, and 7000 ppm of $O_2$ (0.7%) at 300° C. for 15 minutes. Thereafter the screws were heated to 500° C., held under an atmosphere of $N_2$ and 90% $H_2$ for 30 minutes, then nitrided under an atmosphere of 20% $NH_3$ and 80% RX (where $H_2O$ and $CO_2$ are eliminated by incomplete combustion of methane, propane and the like in the air and its composition is basically $N_2$+CO (20%)+$H_2$ (30%)) for 3 hours, and taken out from the furnace. Uniform nitrided layers of 40 to 50 μm were formed on the whole screw surfaces.

Further, as Comparative Example 4, the same treatment as that of Example 2 was conducted except that the oxygen concentration was changed to 0.05%, which falls out of the range for the oxygen concentration of 0.1 to 4% in this invention. Nitrided layers of thus obtained works were uneven, and the whole surface hardnesses of the screw tops were from Hv=430 to 1200, which varied widely, resulting in much lower performance than that in Example 2.

Still further, as Comparative Example 5, the same treatment as that of Example 2 was conducted except that the oxygen concentration was changed to 5%, which falls out of the range for the oxygen concentration of 0.1 to 4% in this invention. Nitrided layers of thus obtained works were uneven, and the whole surface hardnesses of the screw tops were from Hv=430 to 1150, which varied widely, resulting in much lower performance than that in Example 2.

EXAMPLE 3 AND COMPARATIVE EXAMPLES 6 AND 7

SUS 304 shafts exposed to strong cold extension working and strong cutting and grinding finish were charged into a furnace as shown in FIG. 1. The shafts were heated and fluorinated under an $N_2$ atmosphere containing 25000 ppm of $NF_3$ and 5000 ppm of $O_2$ (0.5%) at 320° C. for 10 minutes. The works were then heated to 580° C. , held under a mixed gas of 50% $NH_3$ and 50% RX for 2 hours, and taken out from the furnace. As a result, uniform nitrided layers with a surface hardness of Hv=1150 to 1280 (base material hardness was Hv=350 to 420) and a thickness of 40 μm were obtained.

On the contrary, as Comparative Example 6, the same works were cleaned with alcohol and then fluorinated under a mixed gas containing 50000 ppm of $NF_3$, and then nitrided under the same conditions as those of Example 3. In addition, as Comparative Example 7, nitriding was carried out under the same conditions as in Example 3 except that $O_2$ was not added at all, although the, concentration of introducing $NF_3$ and the heating temperature of 580° C. were the same. As a result, in the case of Comparative Example 6 where $NF_3$ amount was doubled, the same uniform hard layers as those of Example 3 were obtained, however, in the case of Comparative Example 7, nitriding unevenness occurred such as formation of nitrided layers of partially 15 to 20 μm.

EXAMPLE 4

Grinded samples formed by SKD 61 steel material were cleaned, then charged into a furnace shown in FIG. 1, and held in an $N_2$ gas containing 45000 ppm of $NF_3$ and 2000 ppm of $O_2$ (0.2%) at 350° C. for 60 minutes. The temperature was then risen to 550° C. and the samples were heated in 75% of $NH_3$ for 3 hours. The resultant nitrided layers were 0.15 mm in thickness. No nitriding unevenness was found in the nitrided layers at all.

EXAMPLE 5

SUS 304 shafts, the same samples as used in Example 3, were cleaned with acetone, then charged into a furnace shown in FIG. 1, and held under an $N_2$ atmosphere containing 50000 ppm of $NF_3$ at 350° C. for 20 minutes. For 30 minutes until the furnace was heated to 450° C., the furnace atmosphere was changed to a mixed gas atmosphere of $N_2$ and 6% air. Thereafter, the furnace atmosphere was changed to a nitriding atmosphere containing 50% NH and 50% RX and heated to 580° C. The shafts were held therein for 60 minutes and taken out therefrom. As a result, uniform nitrided hard layers with a surface hardness of Hv=1150 to 1250 and a thickness of 30 μm were formed on the shaft surfaces.

EXAMPLE 6

SUS 304 shafts, the same samples as used in Example 3, were cleaned with acetone, then charged into a furnace shown in FIG. 1, wherein the atmosphere was a mixed gas atmosphere of $N_2$ and 6% air, under which the shafts were held at 350° C. for 30 minutes. Then $N_2$ gas containing 50000 ppm $NF_3$, was introduced into the furnace and the shafts were fluorinated therein at 350° C. for 20 minutes. Thereafter, the furnace gas was changed to be a nitriding atmosphere containing 50% $NH_3$ and 50% RX and heated to 580° C. The shafts were held therein for 60 minutes and taken out therefrom. As a result, uniform nitrided hard layers with a surface hardness of Hv=1150 to 1250 and a thickness of 30 μm were formed on the shaft surfaces.

What is claimed is:

1. A method of nitriding steel which comprises reacting the steel surface with nitrogen so as to form a hard nitrided layer, and conducting the following fluorination (A), (B) or (C) prior to nitriding:

(A) holding steel in a gas atmosphere containing fluorine compound gas or fluorine gas and also containing air equivalent to 0.5 to 20 volume % of the total or oxygen gas equivalent to 0.1 to 4 volume % of the total with heating;

(B) after holding steel in a gas atmosphere containing fluorine compound gas or fluorine gas with heating holding steel in a gas atmosphere containing air equivalent of 0.5 to 20 volume % of the total or oxygen gas equivalent to 0.1 to 4 volume % of the total with heating; or (C) after holding steel in a gas atmosphere containing air equivalent to 0.5 to 100 volume % of the total or oxygen gas equivalent to 0.1 to 20 volume % of the total with heating, holding steel in a gas atmosphere containing fluorine compound gas or fluorine gas with heating.

2. A method of nitriding steel comprising:

fluorinating the steel by holding the steel in a gaseous atmosphere containing a fluorine gas selected from the group consisting of a fluorine compound and fluorine with heating and also holding the steel in a gaseous atmosphere containing air equivalent to 0.5 to 20 volume % of the total or oxygen gas equivalent to 0.1 to 4 volume % of the total with heating; and reacting the steel surface with nitrogen so as to form a hard nitride layer.

3. The method as defined in claim 2, wherein said steel is first held in said gaseous atmosphere containing said fluorine gas and subsequently held in said gaseous atmosphere containing air or oxygen.

4. The method as defined in claim 2, wherein said steel is first held in said gaseous atmosphere containing air or oxygen and subsequently held in said gaseous atmosphere containing said fluorine gas.

* * * * *

UNITED STATES PATENT AND TRADEMARK OFFICE

CERTIFICATE OF CORRECTION

PATENT NO. : 5,650,022
DATED : July 22, 1997
INVENTOR(S) : Kitano, et al

It is certified that error appears in the above-identified patent and that said Letters Patent is hereby corrected as shown below:

Column 7, line 4, after "fluorocarbon" insert --cleaning--;
line 17, after "fluorocarbon" insert --cleaning--.

Signed and Sealed this

Twenty-eighth Day of April, 1998

Bruce Lehman

*Attest:*

BRUCE LEHMAN

*Attesting Officer*

*Commissioner of Patents and Trademarks*